US011098470B2

(12) United States Patent
He

(10) Patent No.: US 11,098,470 B2
(45) Date of Patent: Aug. 24, 2021

(54) TANKLESS WATER-SAVING SEATED TOILET BODY AND ITS FABRICATION METHOD

(71) Applicant: Guanghui He, Santa Clara, CA (US)

(72) Inventor: Guanghui He, Santa Clara, CA (US)

( * ) Notice: Subject to any disclaimer, the term of this patent is extended or adjusted under 35 U.S.C. 154(b) by 0 days.

(21) Appl. No.: 16/101,340

(22) Filed: Aug. 10, 2018

(65) Prior Publication Data

US 2019/0292762 A1 Sep. 26, 2019

(30) Foreign Application Priority Data

Mar. 26, 2018 (CN) ..... 201810256026.0

(51) Int. Cl.
*E03D 11/14* (2006.01)
*E03D 9/08* (2006.01)
*E03D 11/08* (2006.01)

(52) U.S. Cl.
CPC ..... *E03D 11/146* (2013.01); *E03D 9/08* (2013.01); *E03D 11/08* (2013.01); *E03D 2201/30* (2013.01); *E03D 2201/40* (2013.01)

(58) Field of Classification Search
CPC ... E03D 11/146; E03D 11/08; E03D 2201/30; E03D 2201/40
USPC ..... 4/420
See application file for complete search history.

(56) References Cited

U.S. PATENT DOCUMENTS

| | | | | |
|---|---|---|---|---|
| 10,407,890 | B2 * | 9/2019 | Kashirajima | E03D 11/08 |
| 2006/0010592 | A1 * | 1/2006 | Matsui | E03D 5/10 4/425 |
| 2007/0061955 | A1 * | 3/2007 | Asada | E03D 11/08 4/425 |
| 2015/0026876 | A1 * | 1/2015 | Shirakawa | E03D 11/08 4/420 |
| 2017/0247871 | A1 * | 8/2017 | Mukerji | E03D 5/10 |

* cited by examiner

*Primary Examiner* — Huyen D Le
(74) *Attorney, Agent, or Firm* — NZ Carr Law Office

(57) ABSTRACT

The invention is related to an article for daily use. It provides a tankless water-saving seated toilet body and its fabrication method. The tankless water-saving seated toilet body comprises a seated toilet main body, which further comprises a bowl, a drainage pipe, a flushing pipe, a flushing device installation space and a body shell. The upper periphery of the sidewall of the bowl has a water loop. The bottom of the bowl has a drainage pipe inlet and a drainage main flushing nozzle. The outside of the bottom of the water loop is attached to the upper periphery of the toilet bowl and the body shell. The flushing device installation space is placed in the back of the main body. The flushing device installation space has a flushing pipet inlet. The flushing device installation space is connected to the water loop and the drainage main flushing nozzle through a flushing pipe. This tankless water-saving seated toilet body features efficient flushing and draining, water-saving, resistance to clogging without the utilization of a traditional water tank, therefore reducing the manufacturing cost. Users can experience a clean and organized toilet space without the material and installation cost of a concealed water tank. The fabrication method is simple yet the finish effect is good.

15 Claims, 3 Drawing Sheets

TANKLESS WATER-SAVING SEATED TOILET BODY AND ITS FABRICATION METHOD

CROSS-REFERENCE TO RELATED APPLICATION(S)

This application claims priority to, and the benefit of, Chinese Patent Application No. 201810256026.0, filed on Mar. 26, 2018, the disclosure of which is incorporated herein by reference in its entirety.

TECHNICAL AREA

The present invention is related to an article for daily use, in particularly, a tankless water-saving seated toilet body and its fabrication method.

BACKGROUND

Currently seated toilets are widely used in the world. Many household, infrastructure, hotels and public facilities install seated toilets in bathrooms. As the seated toilets are implemented more and more widely, the shortcomings are becoming more prominent.

The current main stream seated toilets have two categories:

1. Direct flush type. This kind of seated toilets features a large drainage pipe, high water consumption. They are usually demanded in countries outside of China.

2. Siphon type. This kind of seated toilets applies a "S" drainage pipe to remove waste and form an odor confinement water seal. It features better water utilization efficiency.

Due to their low water consumption amount, siphon seated toilets are widely used in China and have occupied more than 90% of market.

However, the seated toilets based on Siphon mechanism have a few intrinsic problems that are difficult to overcome:

1. The diameter of the drainage pipe is directly correlated to the consumption of water. In order to reduce water consumption, the drainage pipe has to be made small, which in turn increases the chance of clogging.

2. The outlet of drainage pipe has to be located at a lower position than the inlet of the drainage pipe. This has restricted the design of this type to be the ground discharge type only.

3. To reduce the amount of water consumption, the siphon effect needs to form quickly. A water tank is necessary to achieve this by discharging a high amount of water in a short time. As a result, the flushing holes and the auxiliary holes connecting the water tank to the toilet bowl have to be many and large holes. The water utilization efficiency is therefore compromised.

In effort to solving the problems mentioned above, the inventors of present invention have developed a new technology that has integrated the advantages of different types and achieved even better results to meet the all kinds of requirements for a seated toilet.

SUMMARY

According to an embodiment, a tankless water-saving seated toilet body includes a seated toilet main body, which further includes a bowl, a drainage pipe, a flushing pipe, a flushing device installation space and a body shell, the side wall of the upper periphery of the bowl is equipped with a water loop, the bottom of the bowl is equipped with a drainage pipe inlet and a drainage main flushing nozzle facing towards the drainage pipe, the outside of the bottom of the water loop is attached to upper periphery of the bowl and the body shell, the flushing device installation space is placed in the back of the seated toilet main body, the flushing device installation space is equipped with a flushing pipe inlet. The flushing device installation space is connected to the water loop and the drainage main flushing nozzle through the flushing pipe.

The bottom of the water loop may reside on a same plane, the outside of the bottom of the water loop may be attached to the toilet bowl upper periphery and the body shell, the bottom of the water loop may have multiple flushing holes connected to the hollow space of the water loop and the toilet bowl at a position 3-10 mm apart from the inside of toilet bowl upper periphery.

The direction of flushing holes may be arranged at a 20-40° angle against the plane of the bottom of the water loop and a 5-15° against the upper periphery of the bowl and may be pointed towards the wall of the toilet bowl.

The multiple flushing holes on the water loop may be arranged in the same direction and may be distributed uniformly, the flushing nozzle may have a hole diameter of 1-2 mm and/or the number of flushing holes may be 6-19.

The drainage pipe may have a straight rising part starting from the drainage pipe inlet at the bottom of the toilet bowl, and the drainage main flushing nozzle may be facing towards the drainage pipe rising part.

The drainage main flushing nozzle may include multiple main flushing holes, the direction of the main flushing holes might not be intersected in space and may be facing to the rising part of the drainage pipe through the center of the drainage pipe inlet.

The main flushing holes may have a hole diameter of 3-5 mm and/or the number of holes may be 2-3.

The seated toilet main body may include a secondary pipe, the flushing device installation space may be connected to bottom of the toilet bowl by the secondary pipe going through the bottom hole of the flushing device installation space, the outside of the bowl and back to the inside of the bowl through a hole at the bottom of the bowl.

According to another embodiment, a method to fabricate a tankless water-saving seated toilet body includes fabricating multiple main flushing holes at the drainage main flush nozzle, the method of fabricating main flushing holes further includes the material to fabricate the toilet body includes ceramic, resin and metal, when using ceramic to fabricate the seated toilet main body, based on the condition of the bottom of the bowl and the drainage main flushing nozzle, determine the size of main flushing holes, direction and location, fabricate a flushing hole positioning template, when fabricating through-holes on the rough body of the seated toilet, first place the position template on the bottom of the toilet bowl rough body, then use a hole-opening tool to open holes on the drainage main flushing nozzle according to the direction of position template, before the glazing the rough body, use stick or stick-like material to plug the main flushing holes according to the size, position, direction of the holes.

According to another embodiment, a method to fabricate a tankless water-saving seated toilet body includes fabricating multiple flushing holes connected to the hollow space of the water loop and the toilet bowl at the bottom of the water loop that is 3-10 mm apart from the inside of upper periphery of the bowl, the method of fabricating the flushing holes includes the material to fabricate the seated toilet main body includes ceramic, resin and metal, when the main body is made of ceramic, use bamboo or wood toothpick or other material that can be burnt completely during the sintering step, cut them into appropriate length, insert into the rough body until reaching the hollow space of the water loop at pre-determined positions and directions, leave the material in the rough body or pulled out after the rough body has been dried, polished and glazed.

Figure 1:
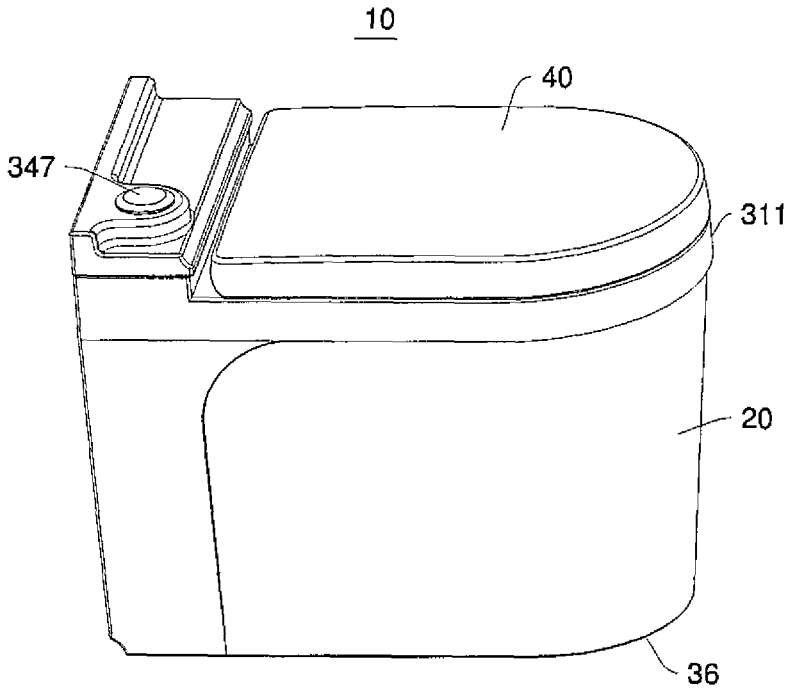
FIG. 1 illustrates a first angle view of the structure of tankless water-saving seated toilet body of present invention.

Notation: 10—tankless water-saving seated toilet body, 20—seated toilet main body, 30—flushing device, 31—bowl, 311—water loop, 3111—flushing holes, 312—drainage main flushing nozzle, 3121—main flushing hole, 313—drainage pipe inlet, 32—drainage pipe, 321—rising part, 33—flushing pipe, 34—flushing device installation space, 340—valve box lid, 347—flushing button, 349—water outlet, 35—secondary pipe, 36—main body shell, 40—cover, 50—seated ring

DETAILED DESCRIPTION

A tankless water-saving seated toilet body and its fabrication method.

The tankless water-saving seated toilet body of present invention features efficient flushing and draining, water-saving, resistance to clogging without using a traditional water tank, therefore reducing the manufacturing cost. Users can experience a clean and organized toilet space without paying for the material and installation cost of a concealed water tank.

The invention has also provided a tankless water-saving seated toilet body fabrication method. The method is simple, easy to implement, low cost and yet the finished product has a good performance.

The invention solves the technique challenges of seated toilets by implementing the following solutions:

An embodiment of present solution provides a tankless water-saving seated toilet body, which further comprises a main body.

The seated toilet main body further comprises a bowl, a drainage pipe, a flushing pipe, a flushing device installation space and a body shell.

The side wall of the upper periphery of the bowl is equipped with a water loop; the bottom of the bowl is equipped with a drainage pipe inlet and a drainage main flushing nozzle facing towards the drainage pipe; the outside of the bottom of the water loop is attached to upper periphery of the bowl and the body shell;

The flushing device installation space is placed in the back of the seated toilet main body; the flushing device installation space is equipped with a flushing pipe inlet. The flushing device installation space is connected to the water loop and the drainage main flushing nozzle through the flushing pipe.

Further, the bottom of the water loop resides on a same plane. The outside of the bottom of the water loop is attached to the toilet bowl upper periphery and the body shell; The bottom of the water loop has multiple flushing holes connected to the hollow space of the water loop and the toilet bowl at a position 3-10 mm apart from the inside of toilet bowl upper periphery.

Further, the direction of flushing holes is arranged at a 20-40° angle against the plane of the bottom of the water loop and a 5-15° against the upper periphery of the bowl and pointed towards the wall of the bowl.

Further, the multiple flushing holes are arranged in the same direction in the water loop and distributed uniformly. The flushing nozzle has a hole diameter of 1-2 mm and/or the number of flushing holes is 6-19.

Further, the drainage pipe has a straight rising part starting from the drainage pipe inlet at the bottom of the toilet bowl, and the drainage main flushing nozzle is facing towards the drainage pipe rising part.

Further, the drainage main flushing nozzle comprises multiple main flushing holes, the direction of the flushing holes is not intersected in space and is facing to the rising part of the drainage pipe through the center of the drainage pipe inlet.

Further, the main flushing holes have a hole diameter of 3-5 mm and/or the number of holes is 2-3.

Further, the seated toilet main body comprises a secondary pipe; The flushing device installation space is connected to bottom of the toilet bowl by the secondary pipe going through the bottom hole of the flushing device installation space, the outside of the bowl and back to the inside of the bowl through a hole at the bottom of the bowl.

An embodiment of present invention has also provided a method to fabricate the tankless water-saving seated toilet body. The method comprises: fabricating multiple main flushing holes at the drainage main flush nozzle;

the method of fabricating main flushing holes further comprises: the material to fabricate the toilet body comprises ceramic, resin and metal; when using ceramic to fabricate the seated toilet main body, based on the condition of the bottom of the bowl and the drainage main flushing nozzle, determine the size of main flushing holes, direction and location; fabricate a flushing hole positioning template; when fabricating through-holes on the rough body of the seated toilet, first place the position template on the bottom of the toilet bowl rough body, then use a hole-opening tool to open holes on the drainage main flushing nozzle according to the direction of position template; before the glazing the rough body, use stick or stick-like material to plug the main flushing holes according to size, position, direction of the holes.

An embodiment of present invention has provided a method to fabricate the tankless water-saving toilet body comprises: fabricating multiple flushing holes connected to the hollow space of the water loop and the toilet bowl at the bottom of the water loop that is 3-10 mm apart from the inside of upper periphery of the bowl;

the method of fabricating the flushing holes comprises: the material to fabricate the seated toilet main body comprises ceramic, resin and metal; when the main body is made of ceramic, use bamboo or wood toothpick or other material that can be burnt completely during the sintering step, cut them into appropriate length, insert into the rough body until reaching the hollow space of the water loop at pre-determined positions and directions, leave the material in the rough body or pulled out after the rough body has been dried, polished and glazed.

The benefits of present invention comprise:

The tankless water-saving seated toilet body of present invention features efficient flushing and draining, water-saving, resistance to clogging without using a traditional water tank, therefore reducing the manufacturing cost. Users can experience a clean and organized toilet space without paying for the material and installation cost of a concealed water tank.

The invention has also provided a tankless water-saving seated toilet body fabrication method. The method is simple, easy to implement, low cost and yet the finished product has a good performance.

EXAMPLES

To clarify the purpose, technical solutions and advantages of present invention, an embodiment of the technical solutions of present invention is given below in accordance to the figures of an embodiment. Obviously, the described embodiment is one of the many and not covering all the possible situations. In general, the components of the embodiment of present invention may be arranged in different configurations and designs from the embodiment that is described in the figures and demonstrated here.

As a result, the detailed discussion of the following embodiment of present invention is not intended to limit the range of this invention but solely for the purposes of explaining the chosen embodiment of present invention. Based on the embodiment of present invention, other forms of embodiments achieved by other technical personnel of ordinary skill in the art without using creative labor should belong to the claims of present invention.

In the description of present invention, it's necessary to clarify that the terms "up", "down", "inside", "outside" and the other directional and positional relation are based on the relative positions in the figures, or the directional and positional relation of traditional placement of a product of present invention during usage. The terms are used solely for the purpose of simplifying the description and explanation, not intended to define and indicate the characteristic and necessary position relation or the characteristic operations under a certain direction and position, therefore should not be considered as the limitation of present invention. On the other hand, the terms "first" and "second" are used solely for the purposes of describing the difference and shall not be construed as an instruction or an indication of relative importance.

On the other hand, the terms of "vertical" and the like are not intended to indicate that the necessity of the components to be absolute vertical with each other. A slight inclination should be considered as acceptable. For example, "vertical" means it is more vertical than the horizontal direction and does not mean the structure has to be absolute vertical at 90° and a slight angle difference should be allowed.

In the description of present invention, it's necessary to clarify that unless there's clear regulation and limit, the term "installation", "setup" and "connection" shall be construed in general ways. For example, it could be a fixed connection, a detachable connection, or a unified connection. It could also be a mechanical connection, or an electrical connection. It could be a direct connection, a connection through a media, or an internal connection between two devices. For technical personnel with ordinary skill in the art, the concrete meaning of above terms in the present invention can be comprehended according to the situations.

DETAILED DESCRIPTIONS OF AN EMBODIMENT

Embodiment 1

Figure 2:
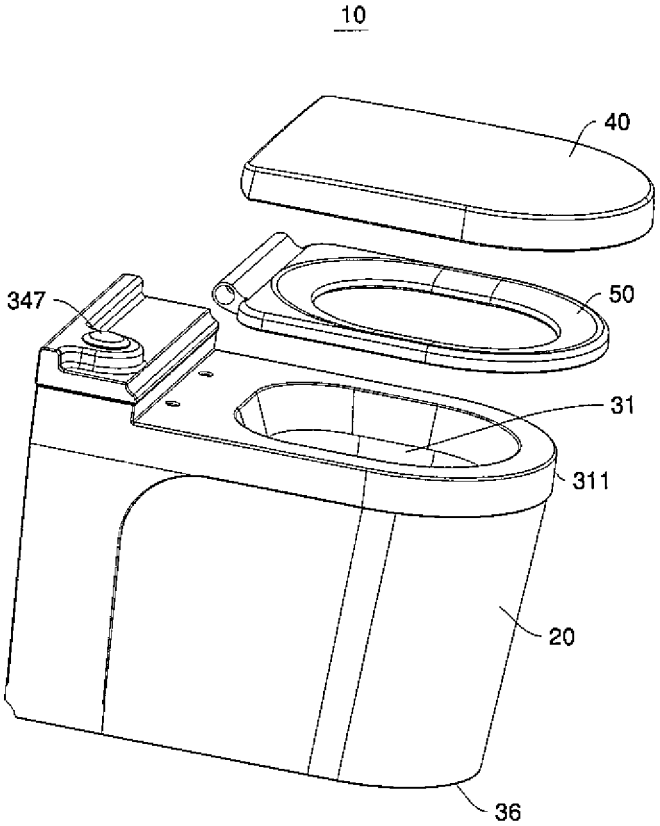
FIG. 2 illustrates a second angle view of the structure of tankless water-saving seated toilet body of present invention.
Figure 3:
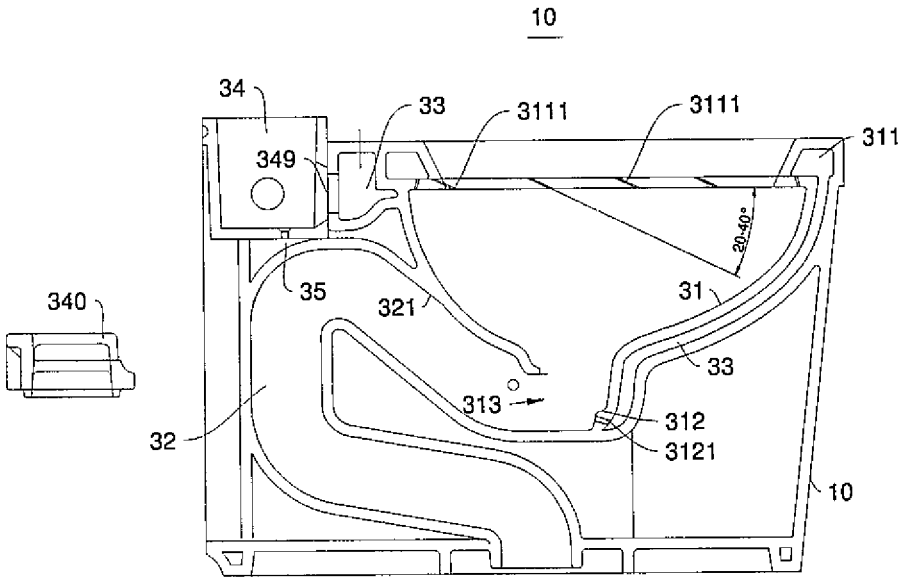
FIG. 3 illustrates a third angle view of the structure of tankless water-saving seated toilet body of present invention.
Figure 4:
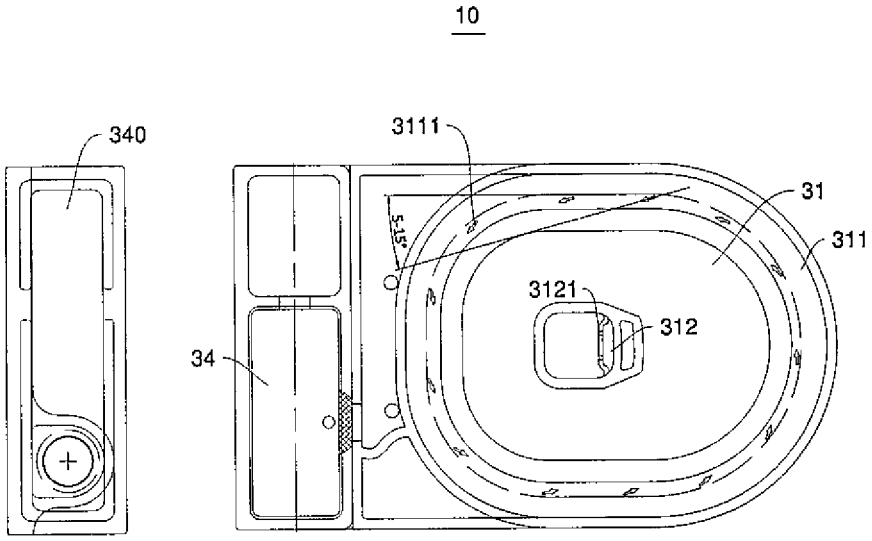
FIG. 4 illustrates a fourth angle view of the structure of tankless water-saving seated toilet body of present invention.
Figure 5:
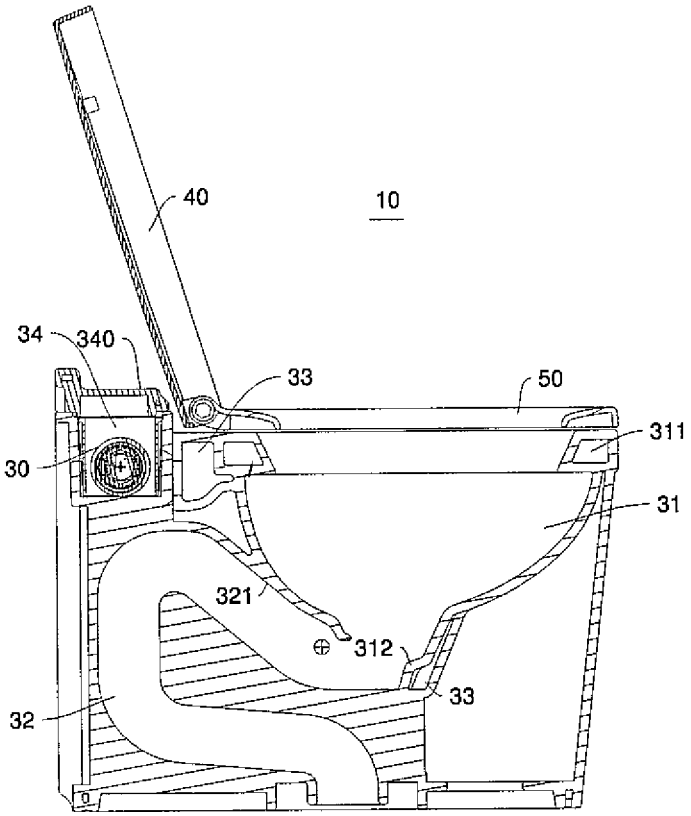
FIG. 5 illustrates a fifth angle view of the structure of tankless water-saving seated toilet body of present invention.

Please refer to FIGS. 1 to 5, the present invention has provided a tankless water-saving seated toilet body 10, which comprises a main body 20.

The main body 20 further comprises a bowl 31, a drainage pipe 32, a flushing pipe 33, a flushing device installation space 34 and a body shell 36.

The seated toilet main body is equipped with a water loop 311 (the water loop 311 has an empty hollow space on the upper periphery of the side wall of the bowl 31. The bottom of the bowl 31 is equipped with a drainage pipe inlet 313 and a main flushing nozzle 312 that is facing to the drainage pipe 32. The outside of the bottom of water loop 311 is connected to the upper periphery of the bowl 31 and the body shell 36.

The flushing device installation space 34 is placed at the back of main body 20. The opening of the flushing device installation space is facing upwards and has a valve box lid 340 to cover.

The flushing device installation space 34 is designed to contain the flushing device 30 that can be connected to the municipal water supply or greywater systems. The flushing device installation space 34 comprises a flushing pipe inlet 33, through which the flushing device installation space is connected to water loop 311 and drainage main flush nozzle 312.

It's worthwhile to explain that the flushing pipe 33 can be added separately or integrated with the main body 20 during fabrication. The water outlet 349 can be the inlet of flushing pipe 33. The drainage main flushing nozzle 312 is preferred to be built together with the bowl 31, however, can also be added separately at the corresponding location.

Compared to existing seated toilet, the tankless water-saving seated toilet body 10 of present invention does not require a traditional water tank. It has applied a specified flushing device 30 that is capable of both ensuring the safety of the water source and blocking the granulated sands and residuals. This device has enabled the seated toilet body to be connected directly to the municipal water supply network or equivalent greywater systems without using an intermediate water tank.

In the embodiment of present invention, the bottom of the water loop 311 is lying on a same plane as a comparison to the conical plane of traditional seated toilets. The outside of the bottom of the water loop 311 is attached to the upper periphery of toilet bowl 31 and the main body shell 36. The bottom of water loop 311 has multiple flushing holes 3111 connecting the hollow space of the water loop 311 to the toilet bowl 31 at a position that is 3-10 mm apart from the inside of upper periphery of toilet bowl 31.

As a reference, the direction of flushing holes 3111 of the embodiment is positioned at a 20-40° angle against the bottom plane of water loop 311 and at a 5-15° angle against the upper periphery of the bowl and pointed towards the wall of the toilet bowl 31.

Preferably, the multiple flushing holes 3111 are distributed uniformly in the same direction along the upper periphery of water loop 311. The same direction here may be interpreted as the same following direction or same countering direction. The diameter of the flushing holes 3111 is 1-2 mm and/or the number of flushing holes is 6-19 (for example 10). These flushing holes 3111 have a better flushing and water utilization efficiency compared to the 30-40 of 4 mm big holes of traditional seated toilets.

The drainage pipe 32 has a straight rising part 321 at the bottom of the bowl 31 starting from the drainage pipe inlet 313. The main flushing nozzle 312 is facing the rising part 321 of the drainage pipe 32.

The drainage main flushing nozzle 312 comprises multiple main flushing holes 3121. The directions of multiple main flush holes 3121 are not intersected in space. The direction of main flushing holes 3121 are facing towards the rising part 321 of the drainage pipe 32 through the middle of drainage pipe 313.

The diameter of the main flushing holes 3121 is 3-5 mm and/or the number of main flush holes 3121 is 2-3. Traditional seated toilet usually doesn't comprise a flushing hole at the corresponding location or comprises only big auxiliary flushing holes bigger than 15 mm. Through the setup of main flushing holes 3121 of the present embodiment, seated toilets can not only achieve a better flushing efficiency by combining with flushing holes 3111 but also save water, prevent odor and clogging.

Further, the main body 20 comprises a secondary pipe 35. The secondary pipe 35 is connecting the flushing device installation space 34 and the inside of the bottom of toilet bowl 31 through the outside of the bowl 31, the bottom hole of flushing device installation space 34 and the bottom holes of the bowl 31. It is worthwhile to mention that the secondary pipe can be installed separately or built together with the main body 20.

Further, the tankless main body 10 comprises a cover 40 and a seated ring 50, which can be rotated and connected to the main body of seated toilet 20.

According to the design of present invention, the water loop 311, drainage main flushing nozzle 312, water supply pipe and the others can be built together with the toilet bowl 31, drainage pipe 32, and main body shell 36, or separately and then assembled later.

Above all, the embodiment of the tankless water-saving seated toilet body 10 of present invention has firstly discarded the necessary water tank of traditional seated toilets, later through the setup of flushing holes 3111 and drainage main flushing holes 3121 that are entirely different from traditional seated toilet, changed the flushing mechanism of traditional seated toilets and achieved a seated toilet with better flushing efficiency, discharging capability, water utilization efficiency, and resistance to clogging. This seated toilet has discarded the usage of a traditional water tank, therefore reducing the manufacturing cost. The users therefore can experience a cleaner and more organized bathroom space and at the same time reduce the cost of installing a concealed toilet.

On the other hand, the embodiment has also provided a method to fabricate the above tankless water-saving seated toilet body 10. The materials to fabricate the main body 20 comprises ceramic, resin, or metal.

Among them, when the main body 20 is made of ceramic, the fabrication method of the main flushing holes 3121 of the tankless water-saving seated toilet body may comprise: determine the hole size, position and direction of main flush hole 3121 according to the tankless water-saving seated toilet body 10; fabricate a positioning template according to the condition of the bottom of the bowl 31 and the drainage main flushing nozzle 312; open holes on the seated toilet rough body, firstly by placing the positioning template on the bottom of toilet bowl rough body, then poking holes on the drainage main flush hole 312 by using piercing tools such as tube or drill at the positions according to the template; block the main flush holes 3121 of the rough body before glazing. When the main body 20 is made of ceramic, block the holes before glazing by using small items such as sticks that match with the size, position and direction of main flush holes 3121 to prevent the glaze from flowing into the holes and changing the size and direction of the holes.

The fabrication method of the flushing holes 3111 in the tankless water-saving toilet body 10 comprises: When fabricating the flushing holes 3111 in the rough body of main body 20, apply bamboo or wood sticks or other material that can be completely burnt later in the sintering of the main body 20 (tooth pick and the like), cut them into an appropriate length, poke into the rough body into the hollow space of the water loop 311 according to the determined positions and directions, later either leave them inside or pulled out after the rough body is dried, polished and glazed.

In summary, the embodiment of present invention has provided a tankless water-saving seated toilet body that features efficient flushing and draining, water-saving, resistance to clogging without using a traditional water tank, therefore reducing the manufacturing cost. Users can experience a clean and organized toilet space without paying for the material and installation cost of a concealed water tank. The fabrication method is simple, easy to implement, low cost and yet the finished product has a good performance.

It is worthwhile to also point out that, if not conflicting, the features of the embodiment of present invention can be combined with each other.

The above description is solely intended for explaining a preferred embodiment of present invention, and not intended to limit the scope of present invention. In the perspectives of technical personnel in the related area, the invention can have many variations, modifications and changes. As long as they are under the spirit and principle of present invention, any modification, exchange, improvement, should all be considered to be under the protection scope of present invention.

What is claimed is:

1. A method to fabricate a seated toilet body, comprising:

a. fabricating a main flushing hole positioning template;

b. placing the positioning template on a bottom of a bowl rough body;

c. opening holes on a drainage main flushing nozzle according to a direction of the positioning template;

d. before the glazing the bowl rough body, using first sticks to plug the main flushing holes according to the size, position, direction of the holes, wherein each main flushing hole has a diameter of about 3-5 mm;

e. poking second sticks into the bowl rough body to form flushing holes each having a diameter of 1-2 mm; and f. sintering the bowl rough body to form a main body, wherein the first and second sticks are burnt during the sintering.

2. The method of claim 1, wherein the first and second sticks are bamboo sticks or wood sticks.

3. The method of claim 1, wherein using first sticks to plug the main flushing holes comprises using 2 to 3 first sticks to plug 2 to 3 main flushing holes.

4. The method of claim 3, wherein poking second sticks into the bowl rough body to form the flushing holes comprises poking 6 to 19 second sticks into the bowl rough body to form 6 to 19 flushing holes.

5. The method of claim 1, wherein forming flushing holes comprises forming flushing holes 3-10 mm apart from an inside of an upper periphery of the bowl rough body.

6. The method of claim 1, wherein forming flushing holes comprises forming flushing holes at a 20-40° angle against a plane of a bottom of a water loop and at a 5-15° angle against an upper periphery of the bowl rough body and pointed towards the bowl rough body.

7. The method of claim 1, wherein forming main flushing holes comprises forming main flushing holes facing a rising part of a drainage pipe through a center of the drainage pipe inlet and not intersected.

8. A method to fabricate a seated toilet body, comprising:

a. using a hole opening tool to form main flushing holes having diameters of 3-5 mm on a drainage main flushing nozzle of a rough body;

b. before glazing the rough body, plugging the main flushing holes using first sticks matching the size, position, direction of the main flushing holes;

e. poking second sticks having diameters of 1-2 mm into the rough body to form flushing holes; and f. sintering the rough body to form a main body, wherein the first and second sticks are burnt.

9. The method of claim 8, wherein forming flushing holes comprises forming flushing holes 3-10 mm apart from an inside of an upper periphery of the rough body.

10. The method of claim 8, wherein forming flushing holes comprises forming flushing holes at a 20-40° angle against a plane of a bottom of a water loop and at a 5-15° against an upper periphery of the rough body and pointed towards the rough body.

11. The method of claim 8, wherein forming main flushing holes comprises forming main flushing holes facing a rising part of a drainage pipe through a center of the drainage pipe inlet and not intersected.

12. The method of claim 8, wherein forming the main flushing holes comprises:

a. fabricating a main flushing hole positioning template matching a shape of a bottom of the rough body;

b. placing the position template on the bottom of the rough body;

c. opening the main flushing holes using the hole opening tool according to holes of the positioning template; and d. removing the positioning template.

13. The method of claim 8, wherein the first and second sticks are bamboo sticks or wood sticks.

14. The method of claim 8, wherein using first sticks to plug the main flushing holes comprises using 2 to 3 first sticks to plug 2 to 3 main flushing holes.

15. The method of claim 14, wherein poking second sticks into the bowl rough body to form the flushing holes comprises poking 6 to 19 second sticks into the bowl rough body to form 6 to 19 flushing holes.

* * * * *